US006553594B2

(12) United States Patent
Broker et al.

(10) Patent No.: US 6,553,594 B2
(45) Date of Patent: Apr. 29, 2003

(54) CONTROL SYSTEM FOR CLOTHES WASHING MACHINE INCORPORATING HEATER

(75) Inventors: John F. Broker, Colfax, IA (US); Kimberly J. Hood, Mitchelville, IA (US); Brett C. Oleson, Newton, IA (US); Evan R. Vande Haar, Pella, IA (US); Stephen J. McCauley, Grinnell, IA (US)

(73) Assignee: Maytag Corporation, Newton, IA (US)

( * ) Notice: Subject to any disclaimer, the term of this patent is extended or adjusted under 35 U.S.C. 154(b) by 83 days.

(21) Appl. No.: 09/956,131

(22) Filed: Sep. 20, 2001

(65) Prior Publication Data

US 2003/0051296 A1 Mar. 20, 2003

(51) Int. Cl.[7] ..... D06F 33/02; D06F 39/04

(52) U.S. Cl. ..... 8/158; 68/12.03; 68/12.12; 68/12.22; 68/16

(58) Field of Search ..... 8/158; 68/12.03, 68/12.12, 12.21, 12.22, 16, 15

(56) References Cited

U.S. PATENT DOCUMENTS

| | | | | |
|---|---|---|---|---|
| 1,420,759 A | | 6/1922 | Sawicki | |
| 2,975,623 A | | 3/1961 | Eichhorn et al. | |
| 3,085,420 A | | 4/1963 | Svensson | |
| 3,750,429 A | * | 8/1973 | Gorsuch | 68/12.22 |
| 4,024,735 A | | 5/1977 | Marchiselli | |
| 4,580,421 A | | 4/1986 | Babuin et al. | |
| 4,949,556 A | | 8/1990 | Knauss | |
| 5,038,586 A | | 8/1991 | Nukaga et al. | |
| 5,749,249 A | | 5/1998 | Jung | |
| 5,832,553 A | | 11/1998 | Merloni | |
| 6,044,510 A | | 4/2000 | Cho | |
| 6,125,490 A | * | 10/2000 | Riechmann et al. | 68/12.03 X |

FOREIGN PATENT DOCUMENTS

| | | | | |
|---|---|---|---|---|
| DE | 3811582 | | 10/1989 | |
| EP | 204984 | | 12/1986 | |
| GB | 830739 | * | 3/1960 | 68/12.22 |

* cited by examiner

*Primary Examiner*—Philip R. Coe
(74) *Attorney, Agent, or Firm*—Diederiks & Whitelaw, PLC

(57) ABSTRACT

A washing machine includes a control system which regulates a heater based on selected cycle operations and selected cycle operations based on heater related parameters. User cycle selections, along with sensed operating parameters including the level and temperature of a washing medium, are used to control the activation state of the heater to control the washing medium to within a preset range of a target temperature. Preferably, the heater is de-activated after a predetermined period of activation has been reached, whenever a door of the washing machine is opened, and during certain selected operating cycle portions, including a bleach fill and latter time cycle portions.

27 Claims, 4 Drawing Sheets

CONTROL SYSTEM FOR CLOTHES WASHING MACHINE INCORPORATING HEATER

BACKGROUND OF THE INVENTION

1. Field of the Invention

The present invention pertains to the art of clothes washing machines and, more particularly, to a system for controlling a clothes washing machine which incorporates a heater.

2. Discussion of the Prior Art

In a typical clothes washing machine, the temperature of the washing liquid is basically established based on wash/rinse temperature selections made by the machine operator for a particular washing operation. Other factors, such as the temperatures of incoming water supplies and surrounding environmental conditions, can also have an affect on the temperature of the washing liquid. In order to counter these potential variations, it has been heretofore recognized that incorporating a heater in a washing machine can aid in establishing consistent washing liquid temperatures and, correspondingly, more uniform washing operations. Such prior art arrangements are exemplified by one or more of U.S. Pat. Nos. 3,750,429, 4,024,735, 4,580,421, 4,949,556, 5,038,586, 5,749,249, 5,832,553 and 6,044,510.

In general, these prior art arrangements concentrate on providing a heater in a washing machine for the sole purpose of establishing and/or maintaining a desired washing liquid temperature. However, the manner in which the heater is regulated during a wide range of control operations can have a significant impact on the consistency, effectiveness and efficiency of various washing operations. With this in mind, there exists a need in the art for a control system for a washing machine which regulates the activation and de-activation of an incorporated heater during specified cycles and cycle times, as well as enables a pre-established cycle operation to be altered based on heater related parameters, in order to enhance the washing characteristics of the machine.

SUMMARY OF THE INVENTION

The present invention is directed to a clothes washing machine incorporating a heater, wherein the washing machine includes a control system that regulates both the heater based on selected cycle operations and selected cycle operations based on heater related parameters. At a base level, the heater, which is preferably positioned in a sump area defined by an outer tub of the washing machine, is adapted to be energized when the washing liquid temperature falls below a target temperature by a pre-establish temperature fluctuation value, e.g., 5° F., during a main washing cycle. On other levels, the heater is controlled so as to be de-activated during predetermined cycle operations, particularly pre-soaking and bleach fill operations. On still other levels, the actual temperature established by the heater is sensed and, if the washing liquid temperature is less than desired during a certain operating cycle, the operation of the cycle itself is modified. For instance, the washing machine of the present invention preferably incorporates a stain cycle option during which the heater is activated. If the temperature of the washing liquid is less than a predetermined temperature, e.g., 95° F., additional time is added to a portion of the stain cycle in order to enhance the stain removal sequence.

Additional objects, features and advantages of the present invention will become more readily apparent from the following detailed description of a preferred embodiment when taken in conjunction with the drawing wherein like reference numerals referring to corresponding parts in the several views.

DETAILED DESCRIPTION OF THE PREFERRED EMBODIMENT

Figure 1:
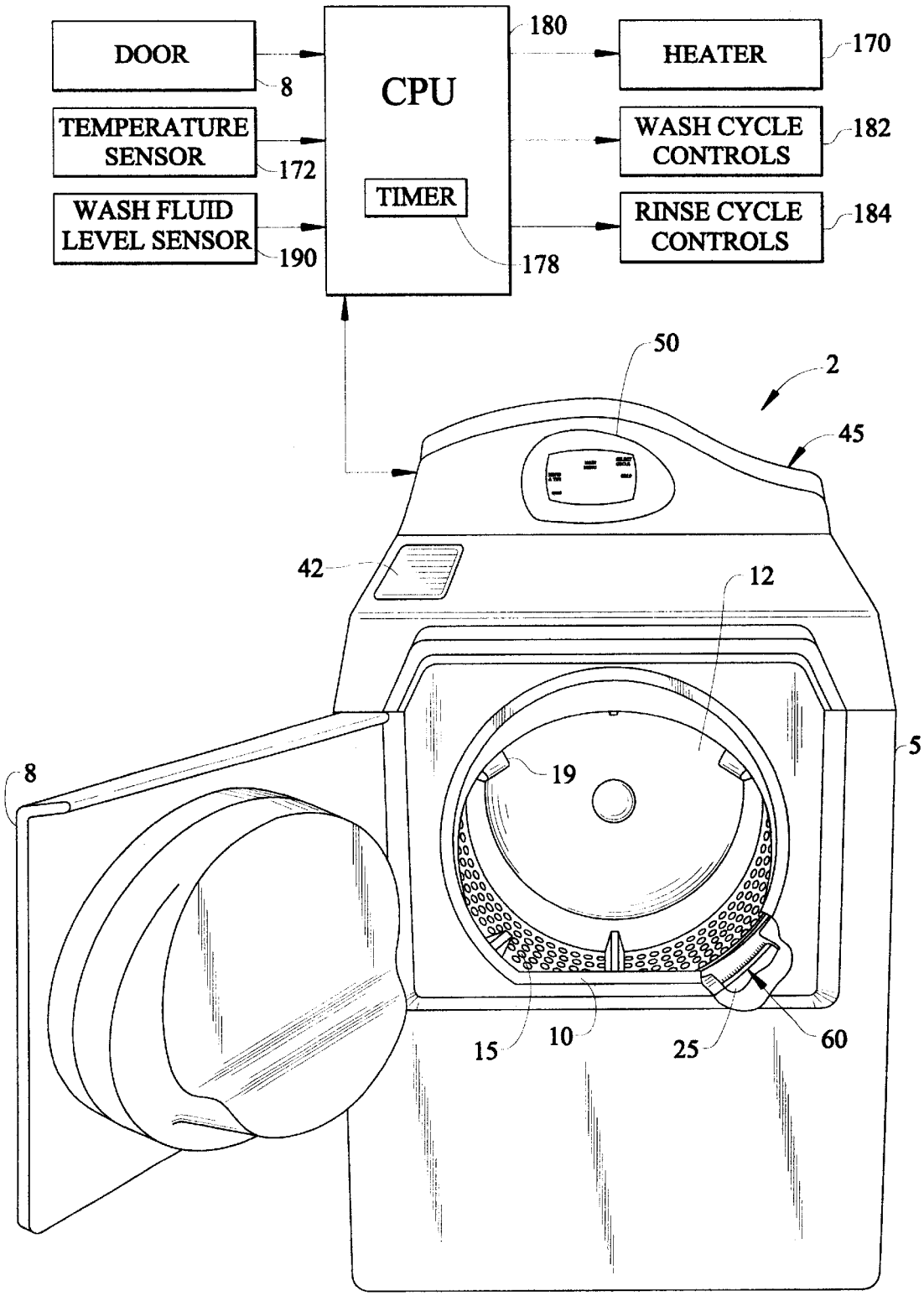
FIG. 1 is a partially cut-away, perspective view of a horizontal axis washing machine incorporating a heater and the control system of the present invention.

With initial reference to FIG. 1, an automatic horizontal axis washing machine incorporating the control system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

Figure 3:
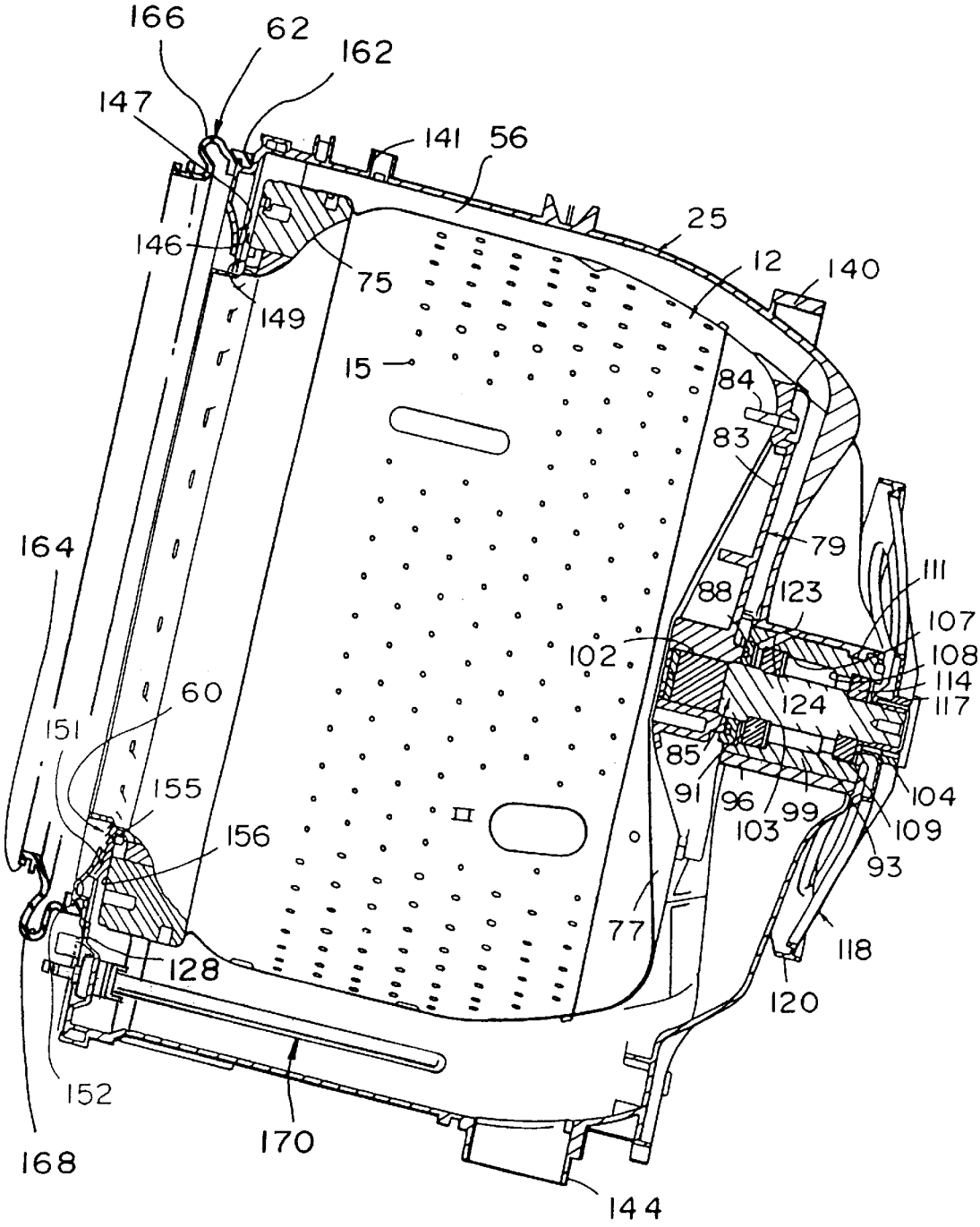
FIG. 3 is a cross-sectional view of the internal components of FIG. 2 in an assembled state.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. Although not shown, a motor, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing medium supplied within inner tub 12. Given that inner tub 12 is provided with at least the plurality of holes 15, the water or water/detergent can flow between the inner and outer tubs 12 and 25. A pumping system (not shown) is provided to control the level of washing fluid within machine 2, with one pump particularly controlling the timed draining of the fluid from the outer tub 25.

Figure 2:
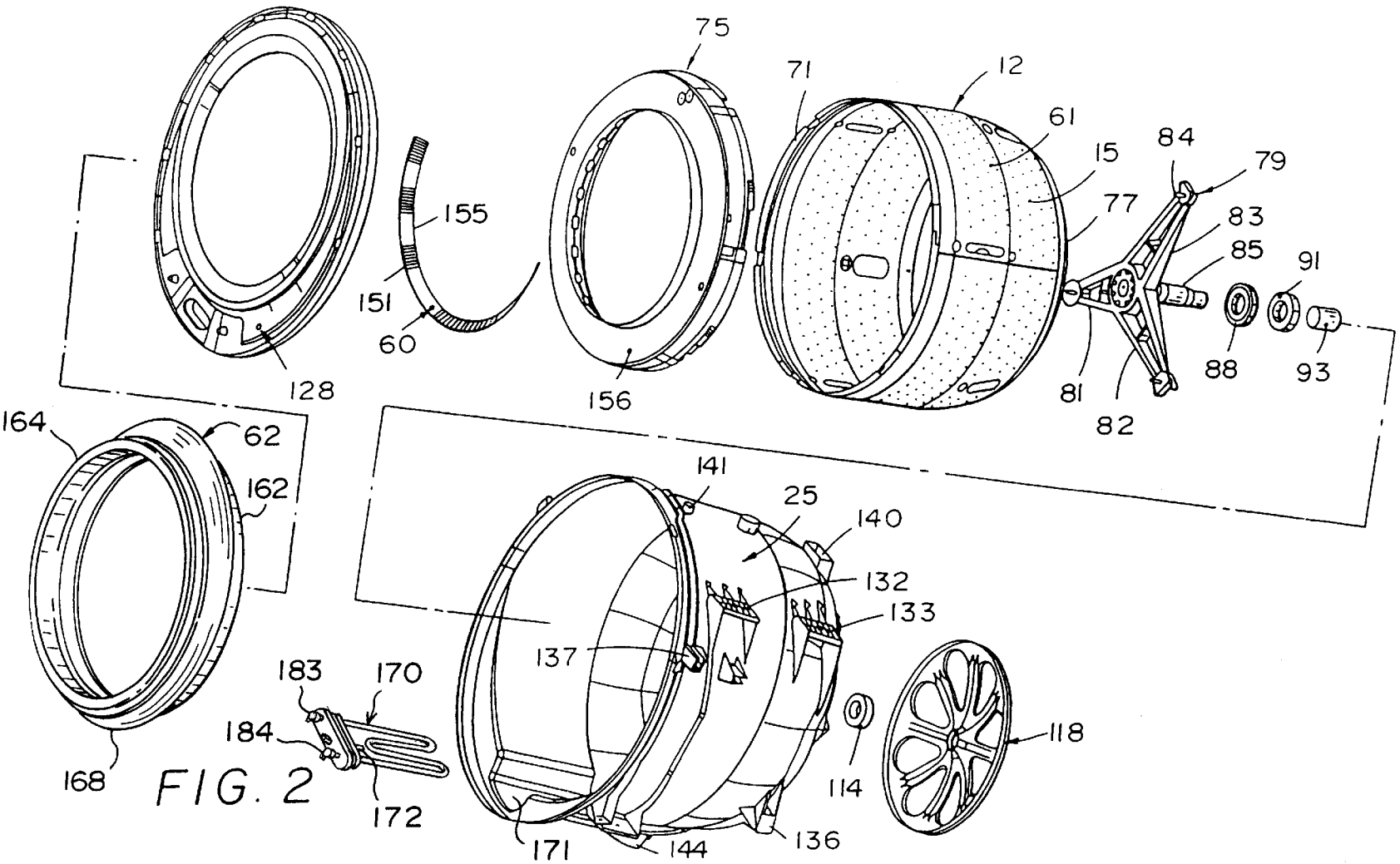
FIG. 2 is an exploded view of various internal components of the washing machine of FIG. 1.

Automatic washing machine 2 is also shown to include an upper cover 42 that provides access to an area for adding detergent, softeners and the like. In addition, an upper control panel 45 includes a touch display 50 through which a user can program washing machine 2. In order to allow inner tub 12 to freely rotate within outer tub 25 during a given washing operation, inner tub 12 is spaced concentrically within outer tub 25 in the manner which will be detailed more fully below. This spacing establishes an annular gap 56 (see FIG. 3) between the inner and outer tubs 12 and 25. A flexible sealing device, generally indicated at 60 in FIGS. 1 and 3, functions to bridge this gap between inner and outer tubs 12 and 25 to prevent such objects from flowing into the outer tub 25. Further provided as part of washing machine 2 in a manner known in the art is a sealing boot 62 (see FIGS. 2 and 3) which extends generally between outer tub 25 and a frontal panel portion (not separately labeled) of cabinet shell 5. Reference now will be made to FIGS. 2 and 3 in describing the preferred mounting of inner tub 12 within outer tub 25 and the arrangement of both sealing device 60 and sealing boot 62.

Inner tub 12 has an annular side wall 61 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer, tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 1 18 includes an outer peripheral surface 120 which is adapted to be connected to a belt driven in a controlled fashion by the reversible motor mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above. Furthermore, outer tub 25 is formed with a drain;port 144 which is adapted to be connected to a pump for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25.

Flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed sealed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a lower trough 168.

Figure 4:
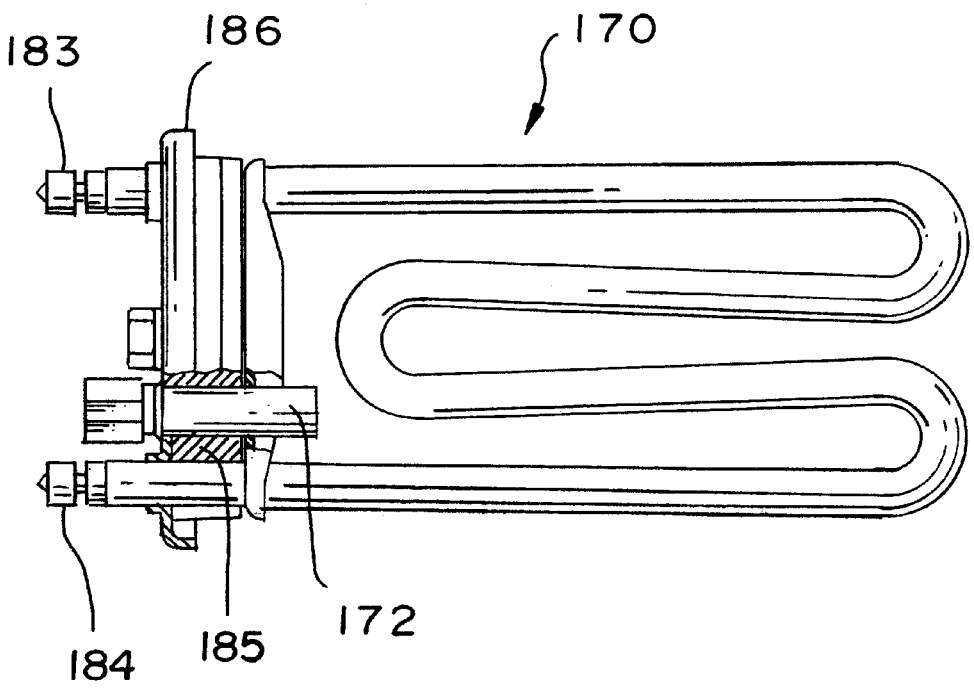
FIG. 4 is a partial cut-away view of a preferred heater module incorporated in the washing machine.

Until this point, the basic structure of washing machine 2 is known in the art and has been described both for the sake of completeness and to establish the need and advantages of the system of the present invention. In accordance with the present invention, a heater 170 is provided in a sump portion 171 of outer tub 25 for use in heating the washing solution used by washing machine 2. Also provided is a temperature sensor 172. During operation of washing machine 2, both heater 170 and temperature sensor 172 are adapted to be submerged in a washing solution established for the selected cycle. As will be detailed more fully below, the operation of heater 170 is regulated through a CPU 180 based on cycle parameters selected by the user through display 50, particular stages of operation of washing machine 2, temperature readings from sensor 172, potential fault conditions and even the position of front door 8. In addition, as will also be detailed fully below, certain cycle parameters are specifically altered based on the operation of heater 170 in accordance with the invention. In the most preferred form, heater 170 constitutes a 1000 watt, sheathed electric heating element 182 having terminal electrical connectors 183 and 184 (see FIG. 4). Electrical connectors 183 and 184 project through a gasket 185 and a mounting plate 186. Preferably, temperature sensor 182 is integrated as part of heater 170 for ease of overall assembly. At this point it should be realized that other heater arrangements could be employed, even a gas heater.

In general, various wash cycles can be selected through display 50, including "Normal", "Extra Rinse" and "Stain Removal" cycles. During a normal washing operation, automatic washing machine 2 will proceed through a main wash cycle and a predetermined number of rinse cycles. In the main wash cycle, a preset amount of water is added to any detergent or other washing solution supplied in the areas beneath cover 42 and inner tub or spinner 12 is driven to tumble articles of clothing through the resulting solution. In the version shown for automatic washing machine 2, the tumbling period is determined by a timer circuit 178 incorporated within a CPU 180 which, in turn, signals the wash and rinse cycle controls as indicated at 182 and 184 in FIG. 1. Periodically, it is preferable to alter the rotational direction of inner tub 12 during this period to vary the tumbling pattern.

After the wash cycle tumbling time period has elapsed, a drain cycle is initiated with a continued tumbling action. In the preferred embodiment, this tumble drain period lasts approximately 90 seconds. Following the tumble drain, inner tub 12 is subjected to a spin mode wherein inner tub 12 spins for approximately two minutes. At this point, the water/detergent solution has been substantially removed from within inner tub 12, although the articles of clothing will certainly still possess a certain percentage of the solution. Next, the articles of clothing are subjected to the predetermined number of rinse cycles wherein inner tub 12 is filled to a predetermined level with water and placed in a rinse cycle tumble pattern. In the most preferred form, three rinse cycles are provided. In general, each of the rinse cycles sequentially incorporate a rinsing tumble mode, followed by a tumble drain, a pause drain and then a rinse cycle spin mode. Thereafter, a final draining occurs and inner tub 12 is allowed to coast to a stop position and the washing operation is completed. Further details of this overall operational sequence is described in commonly assigned U.S. Pat. No. 6,241,782 entitled "Horizontal Axis Washing Machine Incorporating Flush Tumble Cycle" issued Jun. 5, 2001, which is hereby incorporated by reference.

When a stain removal cycle is selected, display 50 presents the user with common types of stains, or an alphabet listing used to input spelling information on a common stain and, by selecting the specific stain type, suggestions for best cleaning of that type of stain. For instance, display 50 can provide exemplary options for "Oil & Grease", "Protein" or "Grass" type stains. In any event, the actual manner in which washing machine 2 can be programmed and operated through selected cycles is fully disclosed in commonly assigned U.S. patent application Ser. No. 09/741,067 entitled "Interactive Control System for a Laundry Gab Appliance" filed Dec. 21, 2000, and now Pat. No. 6,502,265, the disclosure of which is incorporated herein by reference.

At this point, it should again be realized that the specific washing operation described above, including the specific speeds and times established for the various modes of operation are presented for the sake of completeness only and should not be considered limiting to the present invention. Instead, it is the manner in which the control system of the present invention regulates heater 170 and/or alters the conventional washing operation based on sensed washing liquid temperature which is important to the present invention.

When programming washing machine 2, the user can select between cold, warm and hot wash temperatures. During normal wash cycles as selected by the user, heater 170 is preferably retained deactivated regardless of whether a cold, warm or hot wash temperature is selected. Due to the relative amounts of cold and hot water introduced into inner tub 12, this would establish a cold washing solution temperature in the order of 70° F., a warm wash temperature in the order of 105° F. and a hot wash temperature equal to the temperature of the hot water supply for washing machine 2. However, if the stain cycle is selected by the user, regardless of the desired operational temperature, heater 170 will be regulated to enhance the stain removal. More specifically, when a combination cold wash and stain removal cycle option is selected, heater 170 is operated to establish an operational temperature of 80° F. If a warm wash and stain removal cycle option is selected, heater 170 functions to retain the wash solution around the 105° F. temperature. Finally, when a hot wash with stain removal cycle is selected, the wash solution is preferably heated to approximately 130° F.

In each of these stain removal cycles, heater 170 is preferably operated until the temperature of the wash solution reaches the target temperature as discussed above. Thereafter, heater 170 is de-energized. Whenever the actual temperature of the wash liquid, based on signals from temperature sensor 172, falls below by a predetermined degree, e.g. 5° F., during a wash cycle, the heater is re-activated. Again heater 170 will be de-activated when the target temperature is subsequently reached. This operation will continue for the overall main wash cycle. Therefore, the purpose is to maintain the wash temperature between the target temperature and 5° F. therebelow.

Heater 170 is also preferably controlled so as to never be activated for more than a preset amount of time. In the most preferred embodiment of the invention, a 37 minute time limit is employed throughout the main wash cycle. Therefore, heater 170 is cycled off at any point during the main wash cycle when the temperature of the wash liquid reaches the desired target wash temperature, the maximum on time for heater 170 is reached or at the end of the wash period. Furthermore, heater 170 is also preferably maintained de-activated during a latter portion of the main wash cycle, preferably the last four (4) minutes of the cycle.

In accordance with a still further aspect of the present invention, one or more selected cycle operations can be altered based on parameters associated with heater 170. In the most preferred form of the invention wherein heater 170 is particularly utilized in connection with a selected stain removal cycle, if a combination stain removal and hot water cycle is selected, the wash temperature shall be measured by sensor 172 after the desired wash level is reached. If this temperature is sensed to be less than 95° F., then a predetermined period of time is added to the stain cycle. Most preferably, five (5) minutes is added to the tumble portion of the overall stain cycle.

Although the above represents the basic heater control functions of the invention, additional control parameters are also preferably employed in accordance with the present invention. That is, in accordance with a most preferred form of the invention, heater 170 is automatically de-activated whenever door 8 is opened. Furthermore, in accordance with a still further aspect of the invention, the water or wash solution level in outer tub 25 is sensed to be low through a level sensor schematically indicated in FIG. 1 at 190. That is, a minimum water level must exist in outer tub 25 before heater 170 can be activated.

In any event, although described with reference to a preferred embodiment of the invention, it should be readily understood that various changes and/or modifications can be made to the invention without departing from the spirit thereof For instance, although described with reference to a horizontal axis washing machine 2, the heater system of the invention could also be employed in other types of washers, such as vertical axis washers. In addition, although heater 170 has been described as being automatically controlled only when certain cycles are selected, it would also be possible to enable heater 170 to maintain the operating temperatures disclosed above in other wash cycles either automatically or through control panel 45. In general, the invention is only intended to be limited by the scope of the following claims.

We claim:

1. A clothes washing machine comprising:

a cabinet shell including a door;

an outer tub mounted within the cabinet shell;

an inner tub mounted for rotary movement within the outer tub, said inner tub being adapted to receive a washing solution and articles of clothing to be laundered in the washing solution;

a heater arranged within the outer tub;

a control panel for inputting information concerning desired washing operations, with the desired washing operations including at least normal and stain removal cycles; and a device for regulating the heater, wherein the heater is regulated differently between the normal and stain removal cycles.

2. The clothes washing machine according to claim 1, wherein the heater is activated during stain removal cycles and retained de-activated during normal cycles.

3. The clothes washing machine according to claim 1, further comprising: a temperature sensor, linked to the regulating device, for sensing a temperature of the washing solution.

4. The clothes washing machine according to claim 3, wherein when the temperature of the washing solution is less than a predetermined value, at least during a stain removal cycle, the heater is activated to maintain the washing solution within a preset range of a target temperature.

5. The clothes washing machine according to claim 4, wherein the preset temperature range is approximately 5° F.

6. The clothes washing machine according to claim 4, wherein the target temperature is established based on a selection between cold, warm and hot temperature selections made through the control panel.

7. The clothes washing machine according to claim 6, wherein the target temperature is approximately 80° F. when the cold temperature selection is made.

8. The clothes washing machine according to claim 6, wherein the target temperature is approximately 105° F. when the warm temperature selection is made.

9. The clothes washing machine according to claim 6, wherein the target temperature is approximately 130° F. when the hot temperature selection is made.

10. The clothes washing machine according to claim 3, wherein when the temperature of the washing solution is less than a predetermined value, at least during a stain removal cycle, an established operational period for the stain removal cycle is increased by a certain time.

11. The clothes washing machine according to claim 10, wherein the certain time is approximately five minutes.

12. The clothes washing machine according to claim 1, wherein the regulating device only enables the heater to be activated for a limited period of time during the desired washing operation.

13. The clothes washing machine according to claim 12, wherein the limited period of time is approximately thirty minutes.

14. The clothes washing machine according to claim 1, wherein the heater is maintained de-activated during certain portions of the desired washing operation, said certain portions including a bleach fill.

15. The clothes washing machine according to claim 1, wherein the heater is automatically de-activated when the door is opened.

16. The clothes washing machine according to claim 1, wherein the heater is maintained de-activated through a latter time portion of the desired washing operation.

17. The clothes washing machine according to claim 16, wherein the latter time portion equals approximately four minutes.

18. A method of operating a washing machine including a heater for a washing medium comprising:

receiving user inputted information concerning a desired washing operation;

maintaining the heater in a de-activated state until the washing medium in the washing machine reaches a minimum level;

activating the heater to heat the washing medium;

sensing a temperature of the washing medium;

controlling the heater to maintain the washing medium within a preset temperature range from a target temperature during a main portion of the desired washing operation; and de-activating the heater during a latter portion of the desired washing operation.

19. The method according to claim 18, further comprising: limiting a permissible time of activation of the heater during the main portion of the desired washing operation.

20. The method according to claim 19, wherein the permissible time of activation is limited to approximately thirty-seven minutes.

21. The method according to claim 18, further comprising:

receiving a stain removal cycle as the desired washing operation;

altering a pre-programmed stain removal cycle if the temperature of the washing medium is initially less than a predetermined value.

22. The method according to claim 21, wherein the pre-programmed stain removal cycle is altered by increasing an established operational period for the stain removal cycle by a certain time.

23. The method according to claim 18, further comprising:

maintaining the heater de-activated during certain portions of the desired washing operation, with the certain portions including a bleach fill.

24. The method according to claim 18, further comprising:

automatically de-activating the heater when a door of the washing machine is opened.

25. The method according to claim 18, further comprising:

receiving a stain removal cycle as the desired washing operation; and maintaining the washing medium at approximately 80° F. during the main portion of the washing operation when a cold temperature setting is selected.

26. The method according to claim 18, further comprising:

receiving a stain removal cycle as the desired washing operation; and maintaining the washing medium at approximately 105° F. during the main portion of the washing operation when a warm temperature setting is selected.

27. The method according to claim 18, further comprising:

receiving a stain removal cycle as the desired washing operation; and maintaining the washing medium at approximately 130° F. during the main portion of the washing operation when a hot temperature setting is selected.

* * * * *